US008935872B2

(12) United States Patent
Zukowski

(10) Patent No.: US 8,935,872 B2
(45) Date of Patent: Jan. 20, 2015

(54) FIREARM HAVING MAGAZINE SAFETY

(71) Applicant: Smith & Wesson Corp., Springfield, MA (US)

(72) Inventor: Gary Zukowski, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 43 days.

(21) Appl. No.: 13/759,618

(22) Filed: Feb. 5, 2013

(65) Prior Publication Data

US 2014/0215880 A1 Aug. 7, 2014

(51) Int. Cl.
*F41A 17/36* (2006.01)
*F41A 17/56* (2006.01)

(52) U.S. Cl.
CPC ..... *F41A 17/36* (2013.01); *F41A 17/56* (2013.01)
USPC ..... 42/70.02

(58) Field of Classification Search
CPC ..... F41A 17/34; F41A 17/36
USPC ..... 42/70.2, 70.08
See application file for complete search history.

(56) References Cited

U.S. PATENT DOCUMENTS

| | | | | |
|---|---|---|---|---|
| 1,466,749 | A | 9/1923 | Pendersen et al. | |
| 1,638,068 | A | 8/1927 | Tansley | |
| 2,296,998 | A | 9/1942 | Koehler | |
| 3,292,492 | A | 12/1966 | Sturtevant | |
| 4,420,899 | A | 12/1983 | Bourlet et al. | |
| 4,428,138 | A | 1/1984 | Seecamp | |
| 4,589,327 | A | 5/1986 | Smith | |
| 4,987,693 | A | 1/1991 | Brooks | |
| 5,090,148 | A | 2/1992 | Brooks | |
| 5,140,766 | A | 8/1992 | Brooks | |
| 5,225,612 | A | 7/1993 | Bernkrant | |
| 5,388,362 | A | 2/1995 | Melcher | |
| 6,266,909 | B1 | 7/2001 | Fuchs | |
| 6,405,631 | B1 | 6/2002 | Milek | |
| 6,457,271 | B1 | 10/2002 | Vaid et al. | |
| 6,588,136 | B2 | 7/2003 | Baker et al. | |
| 6,865,979 | B1 | 3/2005 | Vaid | |
| 6,976,416 | B2 | 12/2005 | Ealovega | |
| 7,096,618 | B2 | 8/2006 | McGarry | |
| 7,140,141 | B2 | 11/2006 | Vaid | |
| 7,617,628 | B2 | 11/2009 | Curry | |
| 7,690,144 | B2 | 4/2010 | Fagundes De Campos | |
| 7,810,268 | B1 | 10/2010 | McGarry | |
| 8,590,200 | B2 * | 11/2013 | Domian | 42/70.02 |
| 2011/0126441 | A1 * | 6/2011 | Vukovic | 42/70.02 |
| 2011/0162248 | A1 | 7/2011 | Trpcic | |

FOREIGN PATENT DOCUMENTS

| | | | |
|---|---|---|---|
| DE | 518596 | * | 2/1931 |
| EP | 1022534 A2 | | 7/2000 |

* cited by examiner

*Primary Examiner* — Stephen M Johnson
(74) *Attorney, Agent, or Firm* — John A. Chionchio; Ballard Spahr LLP

(57) ABSTRACT

A firearm has a magazine safety and a take-down mechanism. The magazine safety operates in conjunction with a trigger bar and a disconnect bar. The magazine safety has a safety arm which moves the disconnect bar out of engagement with the trigger bar when a magazine is inserted. This permits the trigger bar to engage the sear. When the magazine is removed, the safety arm disengages from the disconnect bar, permitting the disconnect bar to move the trigger bar into a position where it cannot engage the sear. The safety bar also operates as a take-down mechanism. When moved to a take-down position, the safety arm engages and moves the sear into a position where it cannot engage the striker so as to permit removal of the slide carrying the striker from the firearm.

32 Claims, 4 Drawing Sheets

FIREARM HAVING MAGAZINE SAFETY

FIELD OF THE INVENTION

This invention concerns safety and take-down mechanisms for magazine-fed firearms.

BACKGROUND

The magazine safety is an effective safety mechanism for self-loading magazine-fed firearms such as semi-automatic pistols, machine pistols and machine guns. Magazine safeties operate by various different means, but all act to prevent discharge of the firearm when a magazine is not present in the magazine well. However, a disadvantage suffered by many magazine safeties is the need to dry fire the firearm in order to disassemble it for cleaning. For example, this disadvantage affects "hammerless" pistols which use a striker and sear firing mechanism. Dry firing is necessary to clear the sear from engagement with the striker to allow the slide, in which the striker is mounted, to be slid off of the frame of the pistol for take-down. The need to dry fire the pistol presents an additional risk, as anytime the firing mechanism is exercised there is the potential that, through carelessness, an unnoticed chambered round can be inadvertently discharged. There is clearly a need for a safety mechanism which eliminates this additional risk.

SUMMARY

The invention includes a safety mechanism for a firearm having a trigger movably mounted on the firearm, a sear movably mounted on the firearm, and a well for receiving an ammunition magazine. In one example embodiment the safety mechanism comprises a trigger bar attached to the trigger and movable relatively to the sear upon motion of the trigger. The trigger bar is movable between a first position, wherein the trigger bar is engageable with the sear upon motion of the trigger, and a second position, wherein the trigger bar is not engageable with the sear upon motion of the trigger. The trigger bar is biased toward the first position. A disconnect bar is movably mounted on the firearm. The disconnect bar is biased into engagement with the trigger bar so as to move the trigger bar toward the second position. A safety arm is movably mounted on the firearm. The safety arm is movable between a safe position projecting into the magazine well, and a live position engaging and moving the disconnect bar out of engagement with the trigger bar thereby permitting the trigger bar to move into the first position. The safety arm is biased into the safe position and moves into the live position upon insertion of the magazine into the magazine well.

In a particular example embodiment, the trigger bar is pivotably attached to the trigger and rotatably movable between the first and the second positions. In a specific example embodiment, the disconnect bar is pivotably mounted on the firearm and rotatably movable into the engagement with the trigger bar.

In an example embodiment, a first biasing spring acts between the firearm and the disconnect bar for biasing the disconnect bar into engagement with the trigger bar. A second biasing spring acts between the trigger and the trigger bar for biasing the trigger bar into the first position. In this example, the first biasing spring exerts a greater torque than the second biasing spring so as to bias the trigger bar into the second position when the disconnect bar engages the trigger bar.

In a specific example embodiment, the safety arm is pivotably mounted on the firearm and rotatably movable between the safe position and the live position. By way of example, the safety arm comprises a lobe engaging the magazine and the disconnect bar when the safety arm is rotatably moved into the live position.

In another example embodiment, the safety arm is further movable into a take-down position wherein the safety arm engages and moves the sear. In a specific embodiment, the safety arm is pivotably mounted on the firearm and rotatably movable into the magazine well for movement into the take-down position. By way of further example, the safety arm may further comprise a lobe engageable with the sear, the lobe engaging and moving the sear upon rotation of the safety arm into the take-down position.

The invention also encompasses a firearm fed ammunition from a magazine. In a specific example embodiment, the firearm comprises a frame and a well, defined by the frame, for receiving the magazine. In this example embodiment a trigger is movably mounted on the frame. A sear is also movably mounted on the frame. A trigger bar is attached to the trigger and movable relatively to the sear upon motion of the trigger. The trigger bar is movable between a first position, wherein the trigger bar is engageable with the sear upon motion of the trigger, and a second position, wherein the trigger bar is not engageable with the sear upon motion of the trigger. In a specific example the trigger bar is biased toward the first position. A disconnect bar is movably mounted on the frame. The disconnect bar is biased into engagement with the trigger bar so as to move the trigger bar toward the second position. A safety arm is movably mounted on the frame. The safety arm is movable between a safe position projecting into the magazine well, and a live position, engaging and moving the disconnect bar out of engagement with the trigger bar thereby permitting the trigger bar to move into the first position. In this example the safety arm is biased into the safe position and moves into the live position upon insertion of the magazine into the magazine well.

In one example embodiment, the trigger bar is pivotably attached to the trigger and rotatably movable between the first and the second positions. By way of example the disconnect bar is pivotably mounted on the frame and rotatably movable into the engagement with the trigger bar. In a specific example embodiment the firearm may further comprise a first biasing spring acting between the frame and the disconnect bar for biasing the disconnect bar into engagement with the trigger bar, and a second biasing spring acting between the trigger and the trigger bar for biasing the trigger bar into the first position. In this example the first biasing spring exerts a greater torque than the second biasing spring so as to bias the trigger bar into the second position when the disconnect bar engages the trigger bar.

In an example embodiment, the safety arm is pivotably mounted on the frame and rotatably movable between the safe position and the live position. By way of example the safety arm comprises a lobe engaging the magazine and the disconnect bar when the safety arm is rotatably moved into the live position. In an example embodiment the safety arm is further movable into a take-down position wherein the safety arm engages and moves the sear. In an example embodiment, the safety arm is pivotably mounted on the frame and rotatably movable into the magazine well for movement into the take-down position. By way of example the safety arm may further comprise a lobe engageable with the sear, the lobe engaging and moving the sear upon rotation of the safety arm into the take-down position. According to one example of the invention, the firearm comprises a pistol.

The invention further encompasses a pistol, fed ammunition from a magazine. In one example embodiment, the pistol comprises a frame and a well, defined by the frame, for receiving the magazine. A trigger is movably mounted on the frame. A slide is movably mounted on the frame. A striker is movably mounted on the slide. A sear is movably mounted on the frame. A trigger bar is attached to the trigger and movable relatively to the sear upon motion of the trigger. The trigger bar is movable between a first position wherein the trigger bar is engageable with the sear upon motion of the trigger, and a second position, wherein the trigger bar is not engageable with the sear upon motion of the trigger. The trigger bar is biased toward the first position. A disconnect bar is movably mounted on the frame. The disconnect bar is biased into engagement with the trigger bar so as to move the trigger bar toward the second position. A safety arm is movably mounted on the frame. The safety arm is movable between a safe position projecting into the magazine well, and a live position engaging and moving the disconnect bar out of engagement with the trigger bar thereby permitting the trigger bar to move into the first position. The safety arm is biased into the safe position and moves into the live position upon insertion of the magazine into the magazine well.

In one example embodiment, the trigger bar is pivotably attached to the trigger and rotatably movable between the first and the second positions. The disconnect bar is pivotably mounted on the frame and rotatably movable into the engagement with the trigger bar.

In an example embodiment, the pistol further comprises a first biasing spring acting between the frame and the disconnect bar for biasing the disconnect bar into engagement with the trigger bar. A second biasing spring acts between the trigger and the trigger bar for biasing the trigger bar into the first position. In this example, the first biasing spring exerts a greater torque than the second biasing spring so as to bias the trigger bar into the second position when the disconnect bar engages the trigger bar.

In an example embodiment, the safety arm is pivotably mounted on the frame and rotatably movable between the safe position and the live position. In an example embodiment, the safety arm comprises a lobe engaging the magazine and the disconnect bar when the safety arm is rotatably moved into the live position. In an example embodiment, the safety arm is further movable into a take-down position wherein the safety arm engages and moves the sear into a position wherein the sear cannot engage the striker. In an example embodiment, the safety arm is pivotably mounted on the frame and rotatably movable into the magazine well for movement into the take-down position. By way of example, the safety arm comprises a lobe engageable with the sear, the lobe engaging and moving the sear upon rotation of the safety arm into the take-down position. By way of example, the sear is pivotably mounted on the frame and rotatably movable into the positioned wherein the sear cannot engage the striker.

The invention also includes a take-down mechanism for a firearm having a sear and a striker, both movably mounted on the firearm. In one example embodiment, the take-down mechanism comprises a safety arm movably mounted on the firearm. The safety arm is movable into engagement with the sear so as to move the sear between a first position engageable with the striker, and a second position wherein the sear cannot engage the striker. In one example, the safety arm is pivotably mounted on the firearm and rotatably movable into and out of engagement with the sear. In this example embodiment, the safety arm may comprise a lobe engageable with the sear upon rotation of the safety arm.

The invention also encompasses a firearm, the firearm comprising a frame, a sear movably mounted on the frame, and a safety arm movably mounted on the frame. In this example embodiment the safety arm is movable into a take-down position wherein the safety arm engages and moves the sear. In one example embodiment, the safety arm is pivotably mounted on the frame and rotatably movable into engagement with the sear. By way of example, the safety arm may further comprise a lobe engageable with the sear, the lobe engaging and moving the sear upon rotation of the safety arm into the take-down position. The firearm according to the invention may comprise a pistol, for example.

The invention further encompasses a pistol, fed ammunition from a magazine. In an example embodiment, the pistol comprises a frame, a well, defined by the frame, for receiving the magazine, a slide movably mounted on the frame, a striker movably mounted on the slide, a sear movably mounted on the frame, and a safety arm movably mounted on the firearm. The safety arm is movable into engagement with the sear so as to move the sear between a first position engageable with the striker, and a second position wherein the sear cannot engage the striker.

In a particular example embodiment, the safety arm is pivotably mounted on the frame and rotatably movable into the magazine well for movement into the take-down position. By way of example, the safety arm may further comprise a lobe engageable with the sear, the lobe engaging and moving the sear upon rotation of the safety arm into the take-down position. Additionally, the sear may be pivotably mounted on the frame and rotatably movable into the positioned wherein the sear cannot engage the striker.

(In the following description the terms "clockwise" and "counterclockwise" are used only for convenience to describe rotations of various components with respect to the views shown in the referenced drawings.)

DETAILED DESCRIPTION

Figure 1:
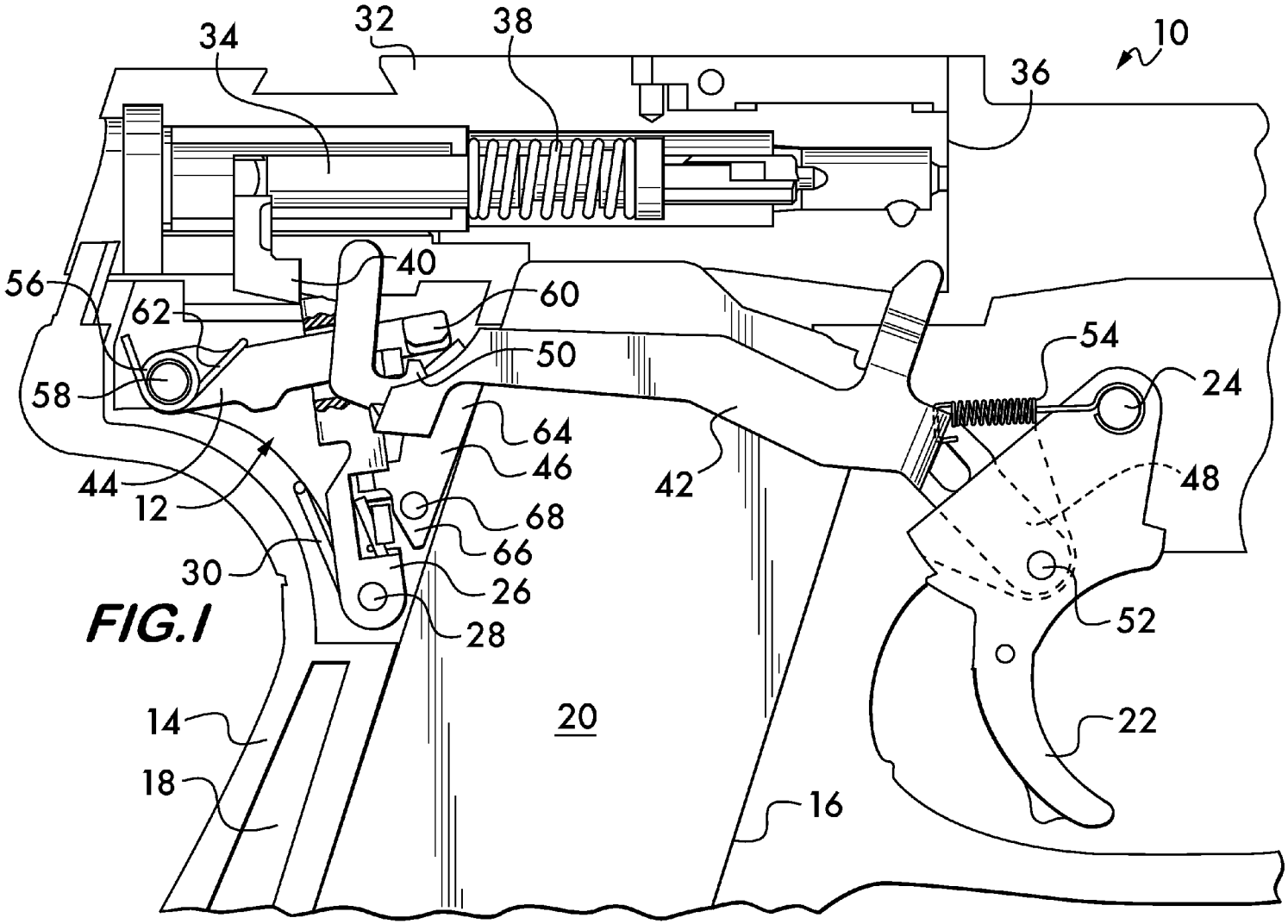
FIG. 1 is a partial longitudinal sectional view of a firearm, namely, a pistol, having an example safety mechanism according to the invention and showing the firearm ready to fire, the magazine being present, the magazine safety being off.

FIG. 1 shows a firearm 10, in this example a pistol, having a magazine safety mechanism 12 according to the invention. Pistol 10 comprises a frame 14 which defines a magazine well 16, in this example positioned within a grip 18, for receiving an ammunition magazine 20, shown positioned within well 16. A trigger 22 is movably mounted on frame 14. In this example, the trigger 22 is pivotably mounted on the frame 14 for rotational movement about a pivot axis 24. A sear 26 is also movably mounted on frame 14, the sear being pivotably mounted in this example for rotational movement about a pivot axis 28. The sear 26 is biased in a clockwise direction about its pivot axis 28 by a biasing spring 30. A slide 32 is mounted atop the frame 14 and is slidably movable relatively to the frame 14 between a battery position (shown) and an open position (see FIG. 3). A striker 34 is movably mounted within the slide 32. Striker 34 is biased toward a breech face 36 of the slide 32 by a compression spring 38. Striker 34 has a surface 40 which is engageable with the sear 26. In FIG. 1, striker 34 is shown with the sear 26 engaging the striker surface 40 and holding the striker 34 in the cocked position with the striker spring 38 compressed. Counter clockwise rotation of the sear 26 (against its biasing spring 30) will cause the sear to fall off of the striker surface 40, thereby releasing the striker, which moves toward the breech face 36 under the biasing action of spring 38. This will effect discharge of the pistol 10 if a live round is chambered (not shown).

Magazine safety mechanism 12 comprises a trigger bar 42, a disconnect bar 44 and a safety arm 46. One end 48 of trigger bar 42 is attached to trigger 22, the opposite end 50 being engageable with the sear 26. In this example, the trigger bar 42 is pivotably attached to the trigger 22 for rotation about a pivot axis 52 offset from the trigger pivot axis 24. Pivotably attaching trigger bar 42 to trigger 22 in this manner allows the trigger bar to move longitudinally relatively to sear 26 as well as rotate about pivot axis 52 between a first position (shown in FIG. 1) wherein the trigger bar is engageable with the sear 26, and a second position (shown in FIG. 2) wherein the trigger bar 42 has rotated counterclockwise and is not engageable with the sear. Note that the trigger bar 42 is biased in a clockwise direction about pivot axis 52 by a spring 54 mounted on trigger 22, thus, the trigger bar 42 is biased into the first position allowing engagement between the trigger bar 42 and the sear 26.

Figure 2:
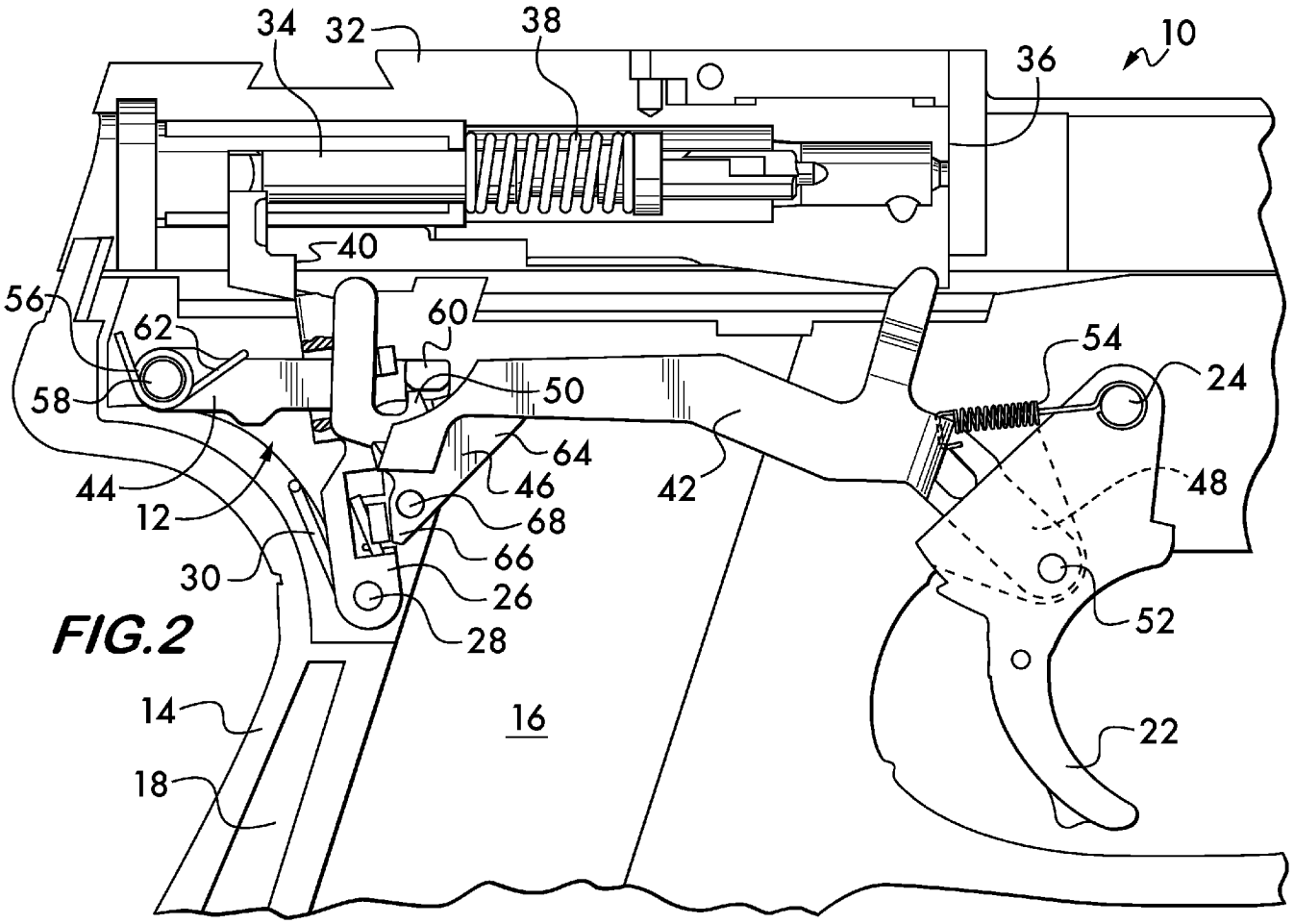
FIG. 2 is a partial longitudinal sectional view of the firearm shown in FIG. 1 with the magazine removed and the magazine safety being on to prevent discharge of the firearm.
Figure 4:
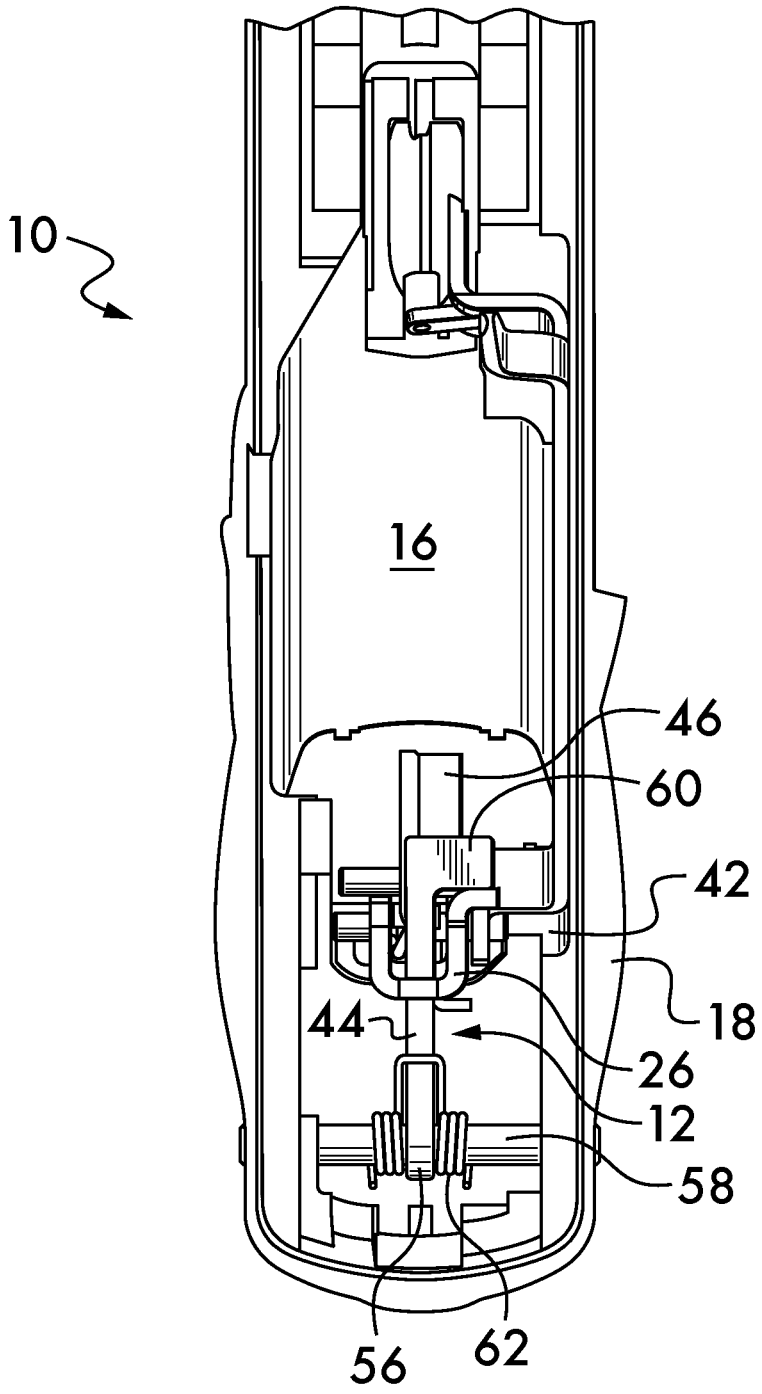
FIG. 4 is a partial top sectional view of the firearm shown in FIG. 1.

Disconnect bar 44 is movably mounted on frame 14. In this example, disconnect bar 44 has a first end 56 pivotably attached to frame 14 for rotation of the disconnect bar about a pivot axis 58. The opposite end 60 of disconnect bar 44 is biased into engagement with end 50 of trigger bar 42 by a biasing spring 62 (see also FIG. 4). The torque exerted by the disconnect bar biasing spring 62 (clockwise direction) is greater than the torque exerted by the trigger bar biasing spring 54 (also clockwise) such that, in the absence of any other force or torque applied to either the disconnect bar 44 or the trigger bar 42, the disconnect bar 44 will rotate the trigger bar 42 counterclockwise into the second position where it cannot engage the sear 26 (see FIG. 2). Such "other" torque or force for moving the disconnect bar 44 is provided by the safety arm 46. Safety arm 46 is movably mounted on the firearm 10 and comprises first and second lobes 64 and 66. In this example, as shown in FIGS. 1 and 2, safety arm 46 is pivotably mounted on frame 14 for rotational motion about a pivot axis 68 between a "live" position, shown in FIG. 1, and a "safe" position, shown in FIG. 2. In the live position of FIG. 1, the lobe 64 engages both the magazine 20 and the disconnect bar 44. In the safe position of FIG. 2, the magazine is removed and the lobe 64 projects into the magazine well 16. Motion of the safety arm 46 into the magazine well 16 is limited by contact between the lobe 66 and the sear 26. When safety arm 46 is in the safe position (FIG. 2), the disconnect bar 44 is free to rotate clockwise about axis 58 under the torque of its biasing spring 62 whereupon the end 60 of the disconnect bar 44 engages the end 50 of the trigger bar 42 and rotates it counterclockwise about its pivot axis 52 against its biasing spring 54 and into the second position where it cannot engage the sear 26. In this configuration the firearm 10 is "safe" and cannot fire if the trigger 22 is pulled because the trigger bar 42 cannot engage the sear 26 and force its rotation about its pivot axis 28 against its biasing spring 30. However, when magazine 20 is inserted into well 16 the magazine engages the lobe 64 and rotates the safety arm 46 into the first position (FIG. 1), forcing lobe 64 to engage the end 60 of disconnect bar 44 and rotate it about its pivot axis 58 and out of engagement with the trigger bar 42. This allows the biasing spring 54 to rotate the trigger bar 42 clockwise about its pivot axis 52 and into the first position where it can engage the sear 26. In this configuration, pulling the trigger 22 will cause the trigger bar 42 to move toward and engage the sear 26, rotating the sear about its pivot axis 28 against its biasing spring 30 and causing the sear to drop off of the striker surface 40. This will permit the striker to be propelled toward the breech face 36 by the striker spring 38 where it can strike a primer of a chambered round (not shown) and discharge the firearm.

Figure 3:
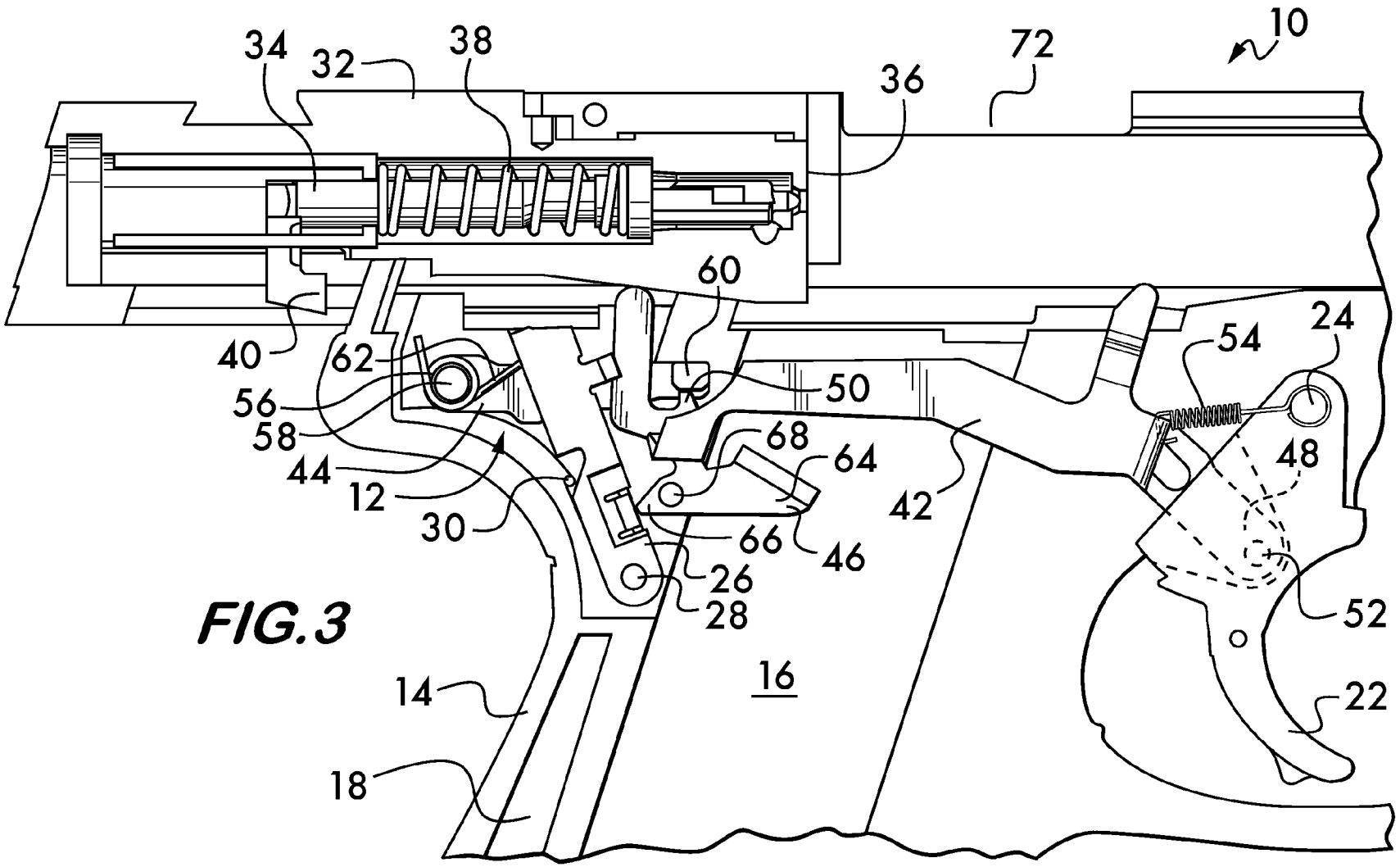
FIG. 3 is a partial longitudinal sectional view of the firearm shown in FIG. 1 with the magazine removed and with the magazine safety in the "take-down" position to permit disassembly of the firearm.

As shown in FIG. 3, the safety arm 46 also comprises a take-down mechanism because the safety arm 46 is further rotatable into a "take-down" position. In the take-down position the second lobe 66 engages and rotates the sear 26 counterclockwise about its pivot axis 28 against its biasing spring 30 and into a position wherein the sear 26 cannot engage the striker 34, in particular, the striker surface 40. When in this configuration the slide 32 can be removed from the frame 14 by disengaging the slide catch (not shown) and sliding the slide to the right, the sear 26 being rotated out of the way so as not to engage the striker surface 40 as the slide 32, and its striker 34, traverse the frame 14. With the slide 32 in the open position (FIG. 3) and the magazine 20 removed from well 16, rotation of the safety arm 46 into the take-down position is effected by inserting a tool or a finger into the well 16 from above through the slide ejection port 72 and further rotating the safety arm 46 clockwise from the safe position shown in FIG. 2 into the take-down position shown in FIG. 3. Assembly of the firearm is accomplished starting with the safety arm 46 in either the safe position or the take-down position. When in the take-down position (FIG. 3), the slide 32 may be mounted on the frame 14 and moved to the open position shown in FIG. 3 without interference from the sear 26, which is held out of the way of striker surface 40 by engagement between the lobe 66 of the safety arm 46 and the sear 26. With the slide 32 held in the open position the safety arm 46 may be rotated counterclockwise from the take-down position into the safe position of FIG. 2 by using a tool or a finger inserted into the magazine well 16, thereby disengaging the lobe 66 from the sear 26 and allowing the sear to rotate clockwise back to the position where it can engage the striker surface 40. Insertion of a magazine 20 into well 16 will also effect the desired counterclockwise rotation of the safety arm 46.

Assembly with the safety arm 46 in the safe position (FIG. 2) proceeds by sliding the slide 32 onto the frame 14. As the slide 32 traverses the frame 14 the striker 34 will contact the sear 26, and, because trigger bar 42 is disengaged from the sear, the sear will be rotated counterclockwise by its contact with the striker 34. Sear 26 will rotate enough to allow striker surface 40 to pass by. After striker surface 40 passes by the sear 26 the sear will return to its at rest position by the action of biasing spring 30.

The combined safety/takedown mechanism according to the invention has the further advantage of being automatically resetting. This is apparent when the pistol is configured as shown in FIG. 3, with the safety arm 46 in the takedown position and the slide 32 in the rearward open position. Insertion of a magazine 20 into the magazine well 16 will rotate safety arm 46 counterclockwise into the live position as shown in FIG. 1. This allows sear 26 to return to its normal rest position under the action of biasing spring 30. If the sled is closed to the battery position as shown in FIG. 1, the pistol will be cocked, magazine safety off, and ready to fire. Thus the design does not require that the safety be reset manually, as the takedown feature is automatically deactivated when the firearm is properly reassembled and loaded with a magazine.

Use of a take-down mechanism in combination with a magazine safety, as in the invention described above, obviates the known disadvantage otherwise affecting the magazine safety because the take-down feature eliminates the need to dry fire the firearm to effect disassembly.

What is claimed is:

1. A safety mechanism for a firearm having a trigger movably mounted on said firearm, a sear movably mounted on said firearm, and a well for receiving an ammunition magazine, said safety mechanism comprising:

a trigger bar attached to said trigger and movable relatively to said sear upon motion of said trigger, said trigger bar being movable between a first position wherein said trigger bar is engageable with said sear upon motion of said trigger, and a second position wherein said trigger bar is not engageable with said sear upon motion of said trigger, said trigger bar being biased toward said first position;

a disconnect bar movably mounted on said firearm, said disconnect bar being biased into engagement with said trigger bar so as to move said trigger bar toward said second position;

a safety arm movably mounted on said firearm, said safety arm being movable between a safe position projecting into said magazine well, and a live position engaging and moving said disconnect bar out of engagement with said trigger bar thereby permitting said trigger bar to move into said first position, said safety arm being biased into said safe position through engagement with said sear and moving into said live position upon insertion of said magazine into said magazine well.

2. The safety mechanism according to claim 1, wherein said trigger bar is pivotably attached to said trigger and rotatably movable between said first and said second positions.

3. The safety mechanism according to claim 2, wherein said disconnect bar is pivotably mounted on said firearm and rotatably movable into said engagement with said trigger bar.

4. The safety mechanism according to claim 3, further comprising:

a first biasing spring acting between said firearm and said disconnect bar for biasing said disconnect bar into engagement with said trigger bar;

a second biasing spring acting between said trigger and said trigger bar for biasing said trigger bar into said first position, said first biasing spring exerting a greater torque than said second biasing spring so as to bias said trigger bar into said second position when said disconnect bar engages said trigger bar.

5. The safety mechanism according to claim 1, wherein said safety arm is pivotably mounted on said firearm and rotatably movable between said safe position and said live position.

6. The safety mechanism according to claim 5, wherein said safety arm comprises a lobe engaging said magazine and said disconnect bar when said safety arm is rotatably moved into said live position.

7. The safety mechanism according to claim 5, wherein said safety arm further comprises a lobe engageable with said sear, engagement between said lobe and said sear biasing said safety arm into said safe position.

8. The safety mechanism according to claim 1, wherein said safety arm is further movable into a take-down position wherein said safety arm engages and moves said sear.

9. The safety mechanism according to claim 8, wherein said safety arm is pivotably mounted on said firearm and rotatably movable into said magazine well for movement into said take-down position.

10. The safety mechanism according to claim 9, wherein said safety arm further comprises a lobe engageable with said sear, said lobe engaging and moving said sear upon rotation of said safety arm into said take-down position.

11. A firearm fed ammunition from a magazine, said firearm comprising:

a frame;

a well, defined by said frame, for receiving said magazine;

a trigger movably mounted on said frame;

a sear movably mounted on said frame;

a trigger bar attached to said trigger and movable relatively to said sear upon motion of said trigger, said trigger bar being movable between a first position wherein said trigger bar is engageable with said sear upon motion of said trigger, and a second position wherein said trigger bar is not engageable with said sear upon motion of said trigger, said trigger bar being biased toward said first position;

a disconnect bar movably mounted on said frame, said disconnect bar being biased into engagement with said trigger bar so as to move said trigger bar toward said second position;

a safety arm movably mounted on said frame, said safety arm being movable between a safe position projecting into said magazine well, and a live position engaging and moving said disconnect bar out of engagement with said trigger bar thereby permitting said trigger bar to move into said first position, said safety arm being biased into said safe position through engagement with said sear and moving into said live position upon insertion of said magazine into said magazine well.

12. The firearm according to claim 11, wherein said trigger bar is pivotably attached to said trigger and rotatably movable between said first and said second positions.

13. The firearm according to claim 12, wherein said disconnect bar is pivotably mounted on said frame and rotatably movable into said engagement with said trigger bar.

14. The firearm according to claim 13, further comprising:

a first biasing spring acting between said frame and said disconnect bar for biasing said disconnect bar into engagement with said trigger bar;

a second biasing spring acting between said trigger and said trigger bar for biasing said trigger bar into said first position, said first biasing spring exerting a greater torque than said second biasing spring so as to bias said trigger bar into said second position when said disconnect bar engages said trigger bar.

15. The firearm according to claim 11, wherein said safety arm is pivotably mounted on said frame and rotatably movable between said safe position and said live position.

16. The firearm according to claim 15, wherein said safety arm comprises a lobe engaging said magazine and said disconnect bar when said safety arm is rotatably moved into said live position.

17. The safety mechanism according to claim 15, wherein said safety arm further comprises a lobe engageable with said sear, engagement between said lobe and said sear biasing said safety arm into said safe position.

18. The firearm according to claim 11, wherein said safety arm is further movable into a take-down position wherein said safety arm engages and moves said sear.

19. The firearm according to claim 18, wherein said safety arm is pivotably mounted on said frame and rotatably movable into said magazine well for movement into said take-down position.

20. The firearm according to claim 18, wherein said safety arm further comprises a lobe engageable with said sear, said lobe engaging and moving said sear upon rotation of said safety arm into said take-down position.

21. The firearm according to claim 11, wherein said firearm comprises a pistol.

22. A pistol, fed ammunition from a magazine, said pistol comprising:

a frame;

a well, defined by said frame, for receiving said magazine;

a trigger movably mounted on said frame;

a slide movably mounted on said frame;

a striker movably mounted on said slide;

a sear movably mounted on said frame;

a trigger bar attached to said trigger and movable relatively to said sear upon motion of said trigger, said trigger bar being movable between a first position wherein said trigger bar is engageable with said sear upon motion of said trigger, and a second position wherein said trigger bar is not engageable with said sear upon motion of said trigger, said trigger bar being biased toward said first position;

a disconnect bar movably mounted on said frame, said disconnect bar being biased into engagement with said trigger bar so as to move said trigger bar toward said second position;

a safety arm movably mounted on said frame, said safety arm being movable between a safe position projecting into said magazine well, and a live position engaging and moving said disconnect bar out of engagement with said trigger bar thereby permitting said trigger bar to move into said first position, said safety arm being biased into said safe position through engagement with said sear and moving into said live position upon insertion of said magazine into said magazine well.

23. The pistol according to claim 22, wherein said trigger bar is pivotably attached to said trigger and rotatably movable between said first and said second positions.

24. The pistol according to claim 23, wherein said disconnect bar is pivotably mounted on said frame and rotatably movable into said engagement with said trigger bar.

25. The pistol according to claim 24, further comprising:

a first biasing spring acting between said frame and said disconnect bar for biasing said disconnect bar into engagement with said trigger bar;

a second biasing spring acting between said trigger and said trigger bar for biasing said trigger bar into said first position, said first biasing spring exerting a greater torque than said second biasing spring so as to bias said trigger bar into said second position when said disconnect bar engages said trigger bar.

26. The pistol according to claim 22, wherein said safety arm is pivotably mounted on said frame and rotatably movable between said safe position and said live position.

27. The pistol according to claim 26, wherein said safety arm comprises a lobe engaging said magazine and said disconnect bar when said safety arm is rotatably moved into said live position.

28. The safety mechanism according to claim 26, wherein said safety arm further comprises a lobe engageable with said sear, engagement between said lobe and said sear biasing said safety arm into said safe position.

29. The pistol according to claim 22, wherein said safety arm is further movable into a take-down position wherein said safety arm engages and moves said sear into a position wherein said sear cannot engage said striker.

30. The pistol according to claim 29, wherein said safety arm is pivotably mounted on said frame and rotatably movable into said magazine well for movement into said take-down position.

31. The pistol according to claim 30, wherein said safety arm further comprises a lobe engageable with said sear, said lobe engaging and moving said sear upon rotation of said safety arm into said take-down position.

32. The pistol according to claim 31, wherein said sear is pivotably mounted on said frame and rotatably movable into said positioned wherein said sear cannot engage said striker.

* * * * *